US005348068A

United States Patent [19]

Elsenheimer et al.

[11] Patent Number: 5,348,068

[45] Date of Patent: Sep. 20, 1994

[54] MINI BLIND HEAD RAIL

[75] Inventors: John A. Elsenheimer; Timothy K. Riddle, both of Freeport, Ill.

[73] Assignee: Newell Operating Co., Freeport, Ill.

[21] Appl. No.: 6,638

[22] Filed: Jan. 21, 1993

[51] Int. Cl.[5] ..... E06B 9/26

[52] U.S. Cl. ..... 160/176.1

[58] Field of Search ..... 160/168.1, 173, 176.1, 160/177, 178.1, 172, 166.1, 170, 171, 84.1

[56] References Cited

U.S. PATENT DOCUMENTS

| | | | |
|---|---|---|---|
| 2,262,949 | 11/1941 | Lorentzen | 160/176.1 |
| 2,587,752 | 3/1952 | Nelson | 160/173 |
| 2,593,048 | 4/1952 | Nelson | 160/177 |
| 2,629,434 | 2/1953 | Nelson | 160/177 |
| 2,821,247 | 1/1958 | Satosky | 160/176.1 |
| 4,377,194 | 3/1983 | Tsuhako | 160/168.1 |
| 4,457,351 | 7/1984 | Anderson | 160/178.1 |
| 5,060,709 | 10/1991 | Simon . | |
| 5,092,387 | 3/1992 | King et al. . | |
| 5,127,458 | 7/1992 | Schaefer et al. . | |

*Primary Examiner*—David M. Purol
*Attorney, Agent, or Firm*—Foley & Lardner

[57] ABSTRACT

A head rail for a mini blind system is disclosed. The mini blind system includes a plurality of pivotable slats supported on flexible ladders that are connected to basket assemblies mounted in the head rail. The head rail includes a pair of sidewalls and a bottom wall. The bottom wall includes flat wall portions and a recessed channel which strengthens the head rail and allows for full pivotable movement of the uppermost mini blind slats. The head rail further includes cross-shaped apertures extending through the recessed channel and configured for locating and receiving the basket assemblies of the present invention. The head rail apertures, as well as the bottom openings on the basket assemblies, include unobstructed cut-out portions which facilitate pivoting of the slats to a position which is very close to a vertical position.

27 Claims, 6 Drawing Sheets

MINI BLIND HEAD RAIL

FIELD OF THE INVENTION

The present invention relates generally to the art of window coverings and more particularly to mini blind head rails.

BACKGROUND OF THE INVENTION

Mini blinds have been known and used for many years for the selective admission of light into a room and for privacy. Typically, mini blinds are installed at a window opening and include a plurality of slats that can be pivoted between an open horizontal position and a closed nearly vertical position.

A conventional mini blind includes a head rail mounted to head rail supports positioned near the top of the window opening. The head rail generally has a U-shaped cross-section with an open interior for receiving the various components that control the pivotable slats. The head rail also includes a number of apertures for access to the various control components, e.g. flexible ladders, basket assemblies, and drawcord assemblies.

The flexible ladders which support the pivotable slats are usually connected to the basket assemblies through appropriate apertures in the bottom of the head rail. Additionally, access holes are provided for the pullcord which raises and lowers the bottom rail and the slats, and for the rotating wand used to control the tilter bar which with the basket assemblies. The basket assemblies, in turn, facilitate control of the flexible ladders which allow the slats to pivot between the open and closed positions.

The basket assemblies generally include a framework which rests within the open interior of the head rail and a rotator element to which the flexible ladders are attached. The ladders each have two flexible strings which are suspended from this rotating element with the strings being connected over opposed sides of the rotating element. Thus, when the rotator element is rotated in one direction., one string will be lowered while the other string is raised, and the opposite result is achieved when the element is rotated in the opposite direction. Each ladder also includes a plurality of cross links connected between the two strings. The slats are positioned over these cross links along the length of the ladders. When the rotator elements are rotated, the slats are pivoted as one end of each cross link is pulled upwards while the other end of each cross link is lowered.

To ensure that each ladder and its respective cross links are pivoted the same amount, a tilter bar extends through each rotator element. The tilter bar is connected to a gearbox at one end of the head rail which, in turn, is connected through an appropriate aperture in the head rail to the rotating wand. Thus, a person may rotate the tilter bar by rotating the wand and pivot the slats to a position that allows total privacy or the desired amount of light to pass through the mini blind.

Usually, a pullcord is also employed with a mini blind so the user may raise or lower the slats in the window opening. Generally, the pullcord enters the head rail through an opening equipped with a locking mechanism, extends along the interior of the head rail, and includes a cord that passes out of the head rail at each socket. Each cord passes through axially aligned apertures in the slats and is connected to a bottom rail below the slats. By pulling on the pullcord, the bottom rail will be raised, thereby raising the slats. The locking mechanism is positioned in the pullcord aperture so the pullcord may be locked and the bottom rail suspended at any point between a fully raised position and a fully lowered position.

In current mini blind systems, problems exist with both the head rail and the baskets. Current head rails have a flat bottom wall. The open design does not resist bending, especially when the head rail extends over a long span. Additionally, during manufacture of a mini blind with this type of head rail, it is difficult to determine when the baskets are accurately located over the cord and ladder apertures. Consequently, the basket installer must often make time consuming adjustments to basket position after the baskets are initially installed into the open portion of the head rail. Also, the flat bottom wall can interfere with the pivotal movement of the uppermost slat towards a fully closed position (i.e., vertical). For instance, the top edge of the uppermost slat may contact the bottom wall of the head rail restricting further pivotal motion of the slats and leaving small spaces between the lower slats through which excess light may filter. It would be advantageous to have a head rail designed to alleviate these problems.

Additionally, full closure of the slats is also inhibited by the design of the ladder apertures and cord apertures in both the bottom wall of the head rail and the basket assemblies. Typically, the lower wall of the head rail includes three openings beneath each basket assembly. Ladder strings are threaded through the outermost apertures, while the drawcord extends through the center aperture. The basket has matching apertures which are aligned with the three head rail apertures when the basket is installed. Since the support strings of the ladder go through apertures separated by a central drawcord aperture, the strings cannot move close enough to one another in the fully closed position to fully pivot the cross links and pivotable slats to a vertical position. It would be advantageous to design both the basket and the head rail so the ladder strings could move sufficiently close to one another that full closure is accomplished.

SUMMARY OF THE INVENTION

The present invention features a mini blind system including a stronger head rail which promotes ease of assembly and more complete closure. The head rail includes a pair of generally parallel side walls and a bottom wall, thus providing the head rail with a generally U-shaped cross section. The bottom wall includes flat portions on either side of a recessed channel extending along the length of the head rail. The bottom wall also includes at least one aperture through which both a ladder and drawcord extend.

The apertures are formed in the bottom wall so that a section of the channel portion and sections of the flat portions are removed. Each basket can thus be located by nesting it within the apertures so that it rests against and is supported by the flat portions of the bottom wall. In this manner, each basket can be precisely located in one rapid step during the assembly process. Additionally, the bottom wall aperture is formed as a single aperture through which both the ladder and the drawcord extend.

Similarly, the basket includes an aperture that is generally aligned with the bottom wall aperture. The basket aperture is a single opening through which both the ladder and drawcord extend. Thus, the side support strings of each ladder are free to move closely towards and away from each other, permitting full closure of the mini blind.

How these features of the invention are accomplished will be described in the following detailed description of the preferred embodiment of the invention taken in conjunction with the drawings. Other ways in which they could be accomplished will appear to those skilled in the art after reading the present specification. Such other ways are deemed to fall within the scope of the present invention if they fall within the scope of the claims which follow.

DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENT

Figure 1:
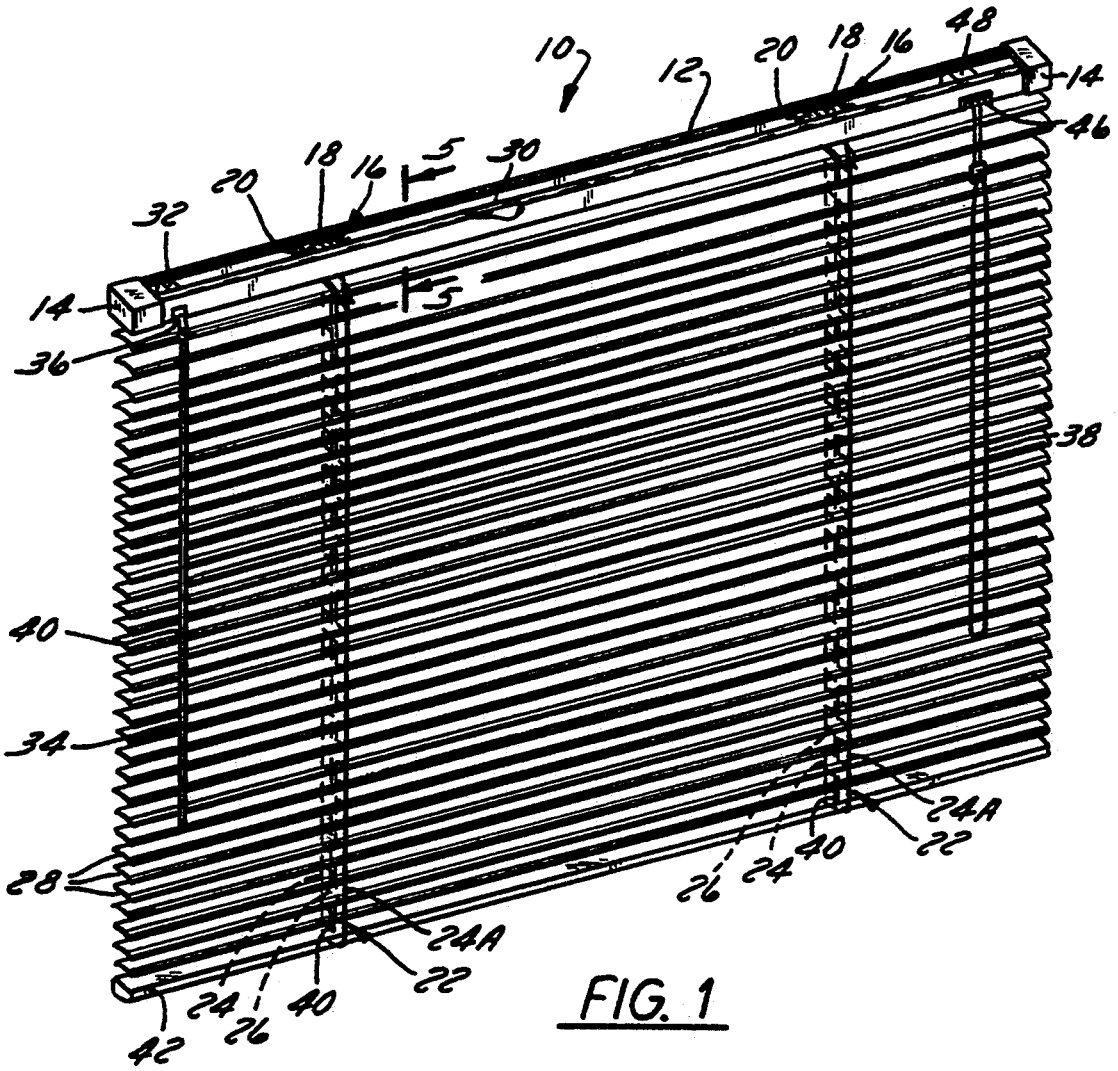
FIG. 1 is a perspective view of a mini blind system according to a preferred form of the present invention showing the overall layout of the components.
Figure 5:
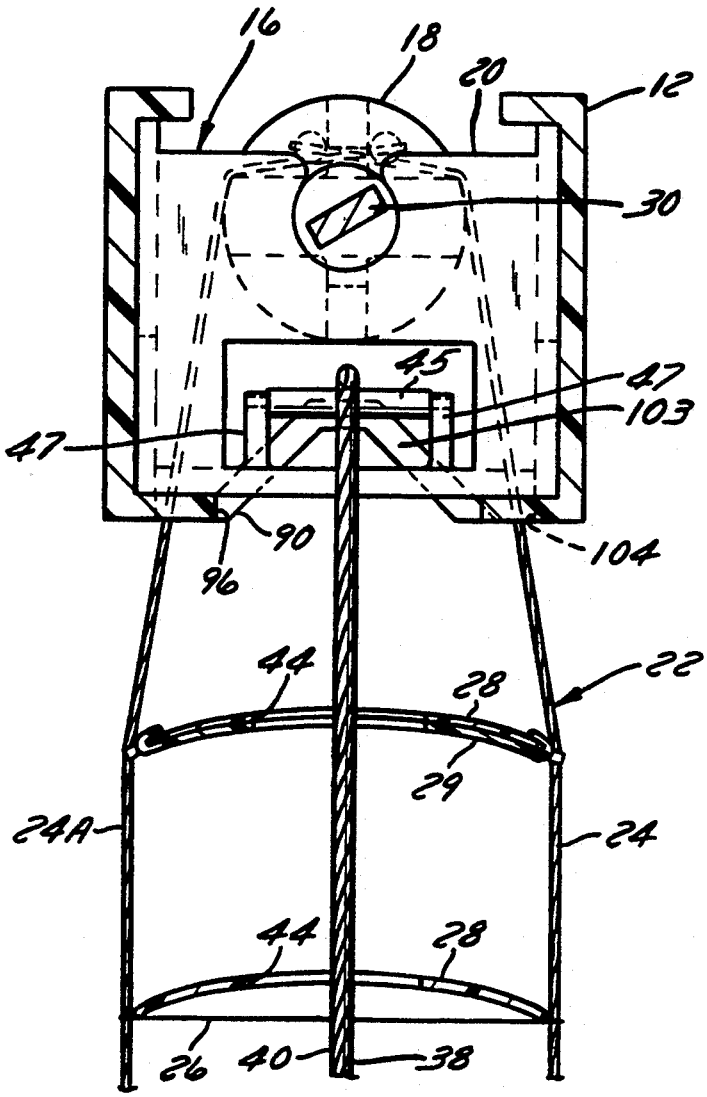
FIG. 5 is a cross-sectional view of the mini blind system including the head rail according to the present invention taken generally along the line 5—5 of FIG. 5 is a cross-sectional view of the mini blind system showing the slats in a vertical position.

Referring generally to FIG. 1, a mini blind system 10 according to the present invention, includes a head rail 12 which is usually mounted near the top of a window opening between a pair of head rail supports 14. As will be appreciated by those skilled in the art, other support structures, including supports intermediate the ends, could be employed. The head rail has a generally U-shaped cross-section and at least one basket assembly 16 and preferably two or more basket assemblies depending on the length of head rail 12. Each basket assembly 16 includes a rotator element 18 mounted within a basket frame 20. These latter elements will be described in greater detail with reference to FIG. 5.

A flexible ladder 22 is suspended from each rotator element. Each flexible ladder includes a pair of side support strings 24 and 24A connected to each other by a plurality of cross links 26. (See also FIG. 5) Pivotable slats 28 are spaced apart from one another and are supported by the cross links 26 as is well known in the art. The uppermost cross link is typically a rigid slat clip 29 which is attached to the uppermost slat 28. Thus, slats 28 rest on the cross links while support string 24A of each flexible ladder 22 is disposed on the front side of the slats and the other support string 24 is disposed on the back side of the slats. The support strings 24 and 24A are similarly connected to the front and back side of each rotator element (See FIG. 5) so that when rotator elements 18 are rotated a first direction, the front support string 24A will move downwardly while the rear support string 24 moves upwardly to pivot the cross links 26 and the slats 28. When the rotator elements 18 are rotated in a second direction, the back support string 24 will move downwardly while the front support string 24A moves upwardly to pivot slats 28 in the opposite direction. In this manner, slats 28 may be pivoted between a fully opened (horizontal) and a fully closed (vertical) position.

A tilter bar 30 extends through each rotator element 18 so they are all rotated simultaneously and by the same amount. Tilter bar 30 is connected to a small gearbox 32 which, in turn, is connected to a control wand 34 through a wand opening 36 formed in head rail 12.

Additionally, the plurality of slats 28 may be raised or lowered in the window opening by a drawcord 38. Drawcord 38 includes one or more draw strings 40 secured to a bottom rail 42 disposed beneath the lowermost of slats 28. From the bottom rail 42, draw strings 40 extend up through axially aligned holes 44 in slats 28, through basket assemblies 16, over rollers 45 (See FIG. 5), and along the interior of head rail 12 to a draw string opening 46. Rollers 45 facilitate the movement of the drawstrings and are each supported by a pair of tabs 47. A locking mechanism 48 (which itself may be of conventional design) is disposed within the drawstring opening 46 to selectively lock the drawstring 40. By pulling on drawcord 38, bottom rail 42 may be raised and lowered to any position the user desires and locked into the desired location using mechanism 48.

Figure 2:
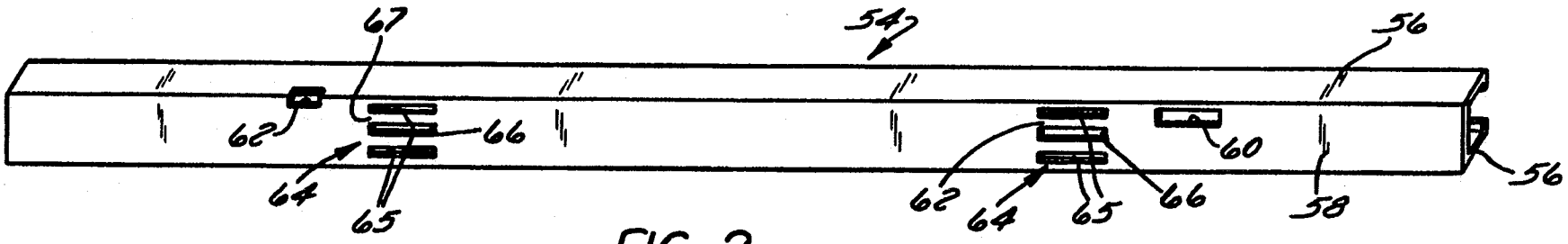
FIG. 2 PRIOR ART
FIG. 2 is a perspective view generally showing the bottom wall of a prior art head rail.
Figure 3:
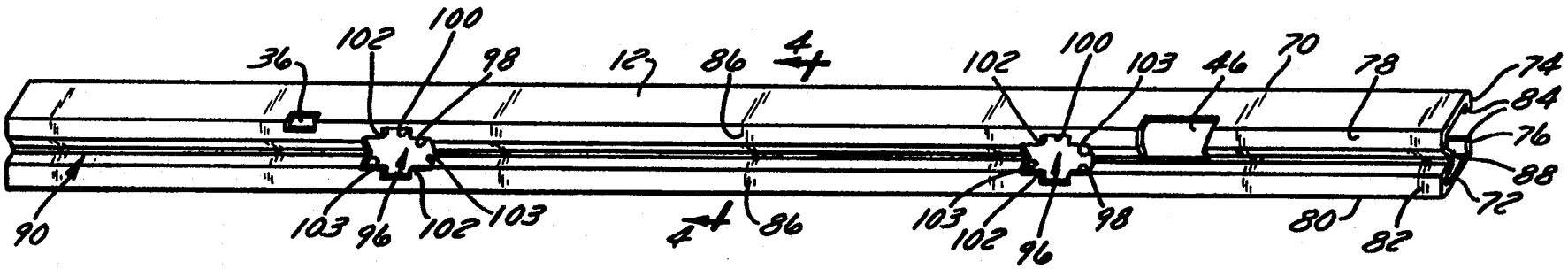
FIG. 3 is a perspective view generally showing the bottom wall of a head rail according to the present invention.

As shown in FIG. 2, a conventional head rail 54 according to the prior art includes a pair of side walls 56 spanned by a bottom wall 58. The bottom wall 58 is substantially planar and includes various apertures such as drawcord opening 60 and a wand opening 62. Additionally, basket assemblies are disposed between side walls 56 and over a triple aperture area 64. The triple apertures include narrow outer apertures 65 through which the ladder support strings extend and a center aperture 66. The outer apertures are separated from the center apertures by divider elements 67. The drawstrings extend through openings 66. As discussed previously, aligning the basket assemblies over these apertures 65–66 is often difficult and adds time to the assembly process.

As illustrated generally in FIGS. 3–6, a head rail 12, according to the present invention, includes a pair of generally parallel sidewalls designated as 70 and 72. Sidewalls 70, 72 include top edges 74 and 76 respectively as well as bottom edges 78 and 80 respectively. A bottom wall 82 extends between edges 78 and 80 of side walls 70 and 72. Bottom wall 82 is preferably integral to the other walls and edges, as head rail 12 is typically an extruded element (e.g., extruded aluminum or vinyl or other materials known to the mini blind art). A pair of flanges 84 extend inwardly from the top edges 74 and 76. As shown most clearly in FIG. 4, head rail 12 has a generally U-shaped cross-section enclosing an elongate longitudinal cavity 85. Alternate embodiments of head rail 12 are illustrated in FIGS. 4A–4D and denoted as head rails 12'–12'''', respectively.

Bottom wall 82 includes a pair of flat portions 86 adjacent edges 78 and 80 and an intermediate, elongate channel portion 88 which extends inwardly along head rail 12. The preferred configuration for channel portion 88 is a V-shape, with the base of the V being truncated. In this configuration, channel portion 88 forms a channel 90 along the outside surface of bottom wall 82. The channel portion 88 provides head rail 12 with greater structural rigidity to resist bending, particularly in the downward direction.

Figure 4:
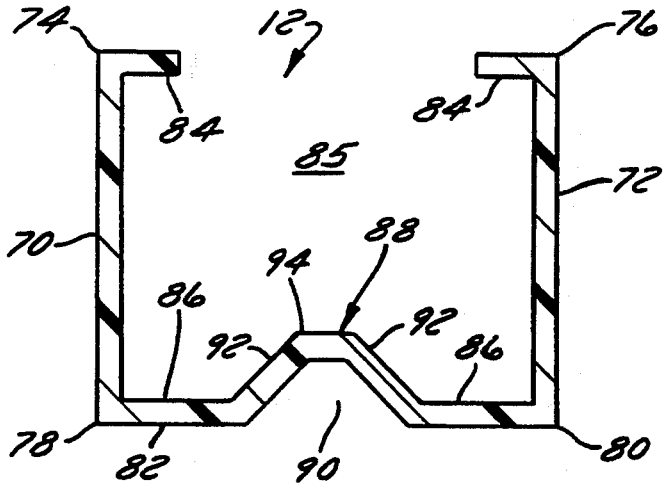
FIG. 4 is a cross-sectional view of the head rail taken generally/along the line 4—4 of FIG. 3.
Figure 4A:
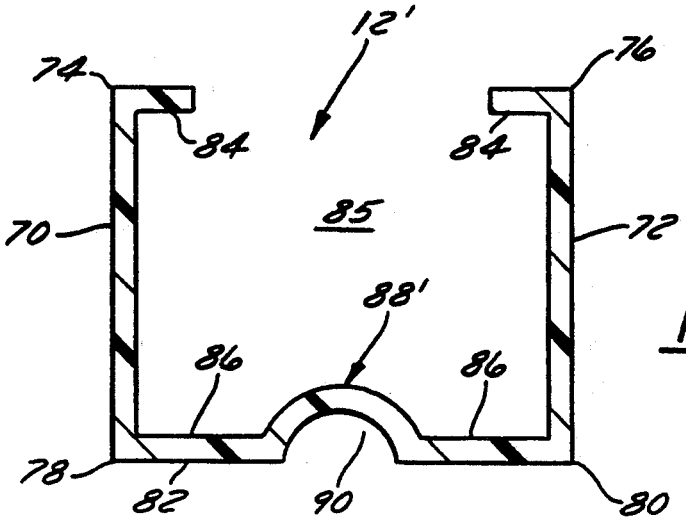
FIG. 4A is a cross-sectional view of an alternate head rail.
Figure 4B:
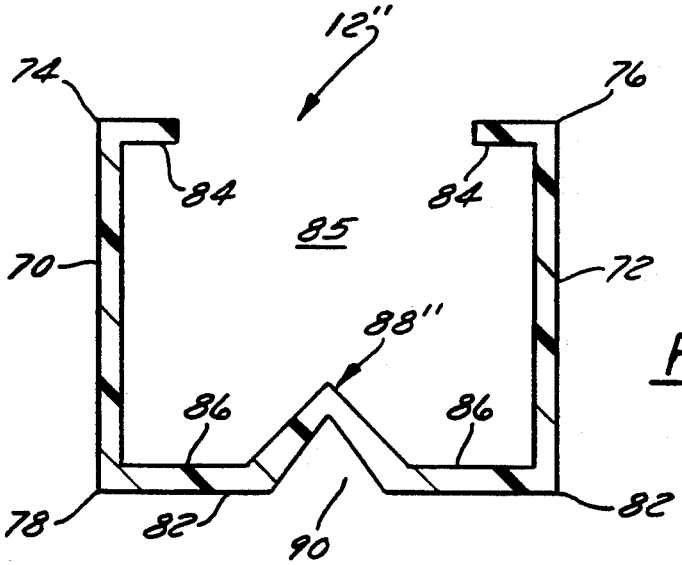
FIG. 4B is a cross-sectional view of an alternate head rail.
Figure 4C:
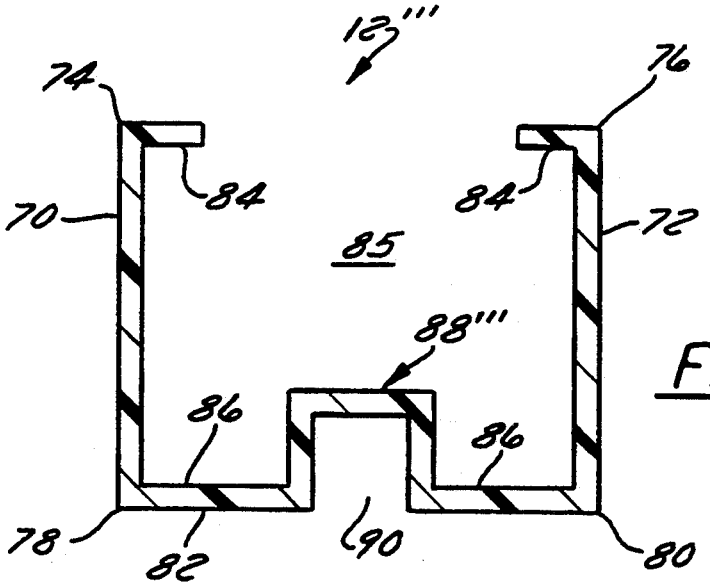
FIG. 4C is a cross-sectional view of an alternate head rail.
Figure 4D:
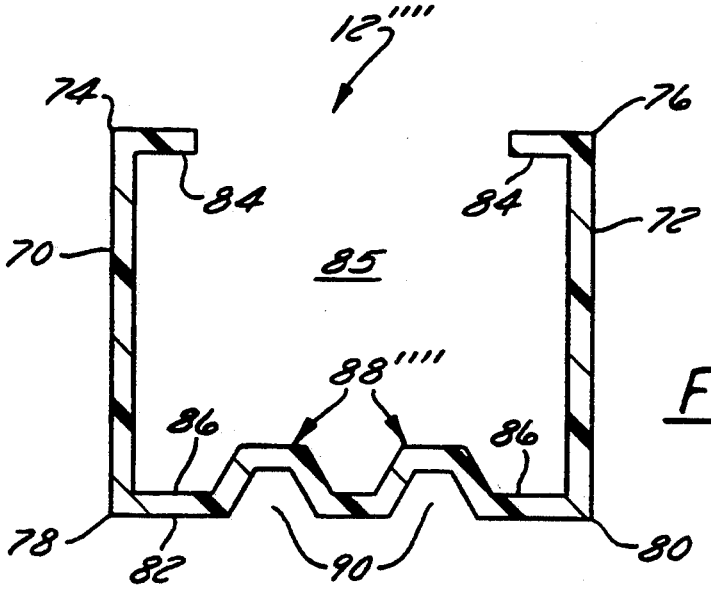
FIG. 4D is a cross-sectional view of an alternate head rail.

Although channel portion 88 is preferably formed as shown in FIG. 4, having angled side segments 92 and a short top segment 94, various other cross-sectional configurations can also be used, e.g. a circular, arcuate, or U-shaped channel portion 88' (see FIG. 4A), a V-shaped channel portion 88'' (see FIG. 4B), a rectangular channel portion 88'''. (see FIG. 4C), or multiple recessed portions forming multiple channels of any of the various cross-sectional configurations (see for example FIG. 4D showing two channel portions 88'''' having truncated V cross-sections).

At least one basket assembly aperture 96 and preferably two or more such apertures extend through bottom wall 82. As illustrated generally in FIG. 3, each aperture 96 extends through portions 86 of the bottom wall 82 as well as through channel portion 88. Preferably, each aperture 96 is shaped like a cross including a longitudinal cut-out 98 and a transverse cut-out 100. The longitudinal cut-out 98 is disposed generally through channel portion 88, while the transverse cut-out 100 is disposed perpendicular to longitudinal cut-out 98 and extends into the flat portions 86 of bottom wall 82. This configuration leaves a plurality of corner tabs 102, preferably four, on which each basket assembly 16 may rest when inserted into longitudinal cavity 85.

The longitudinal cut-out 98 of each aperture 96 is appropriately sized so that the basket assembly frame 20 will nest between aperture ends 103 of the channel portion 88 adjacent each aperture 96. The corner tabs 102, formed at each point of intersection between aperture cut-outs 98 and 100, provide a base on which each basket assembly 16 is supported. This feature also assists in the easy location of the basket assemblies 16 since an installer can slide them along channel 85 until they settle between the aperture ends 103 and come to rest on corner tabs 102.

Figure 5A:
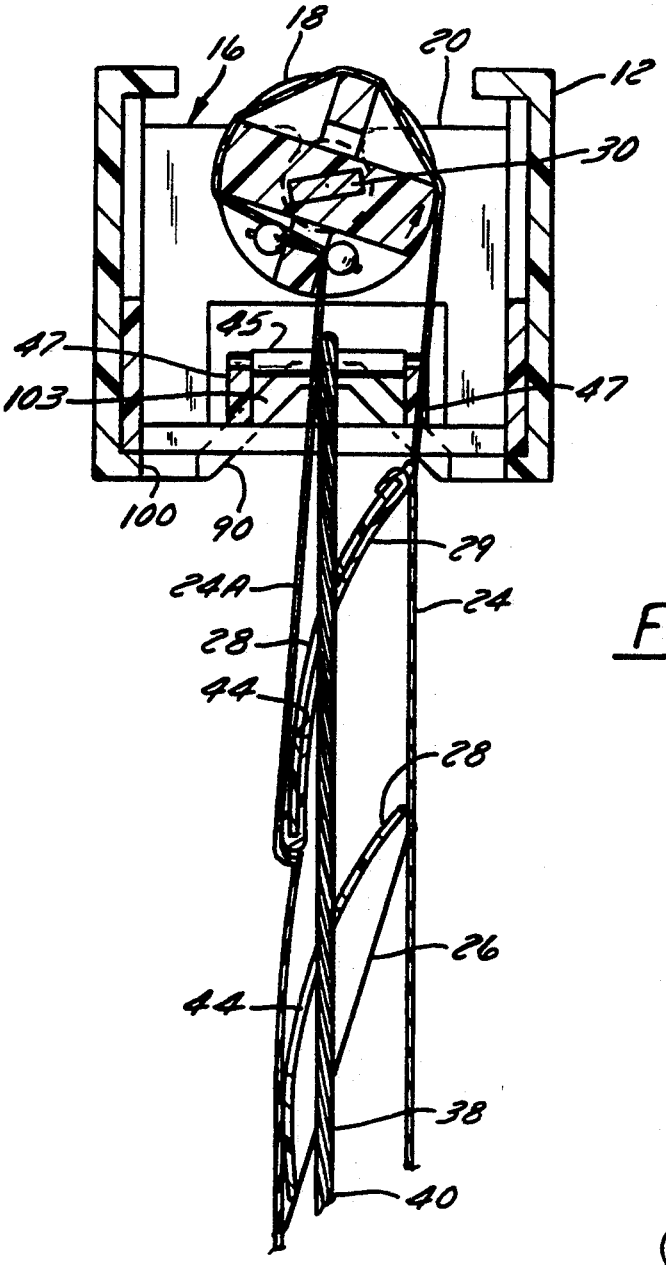
Figure 6:
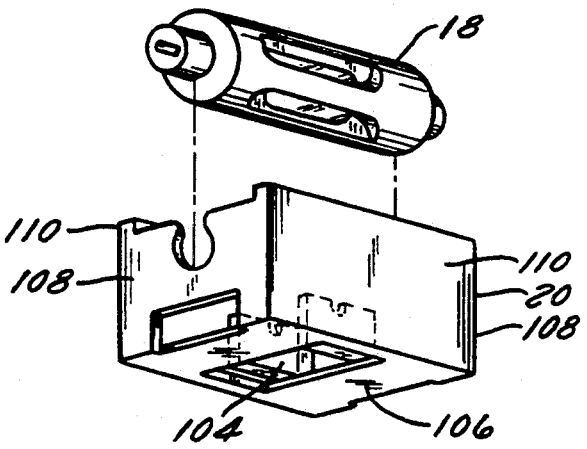
FIG. 6 is a perspective exploded view showing the basket assembly.

Transverse cut-out 100 provides ample room through which flexible ladder 22 and drawcord 38 may extend. Additionally, cut-outs 98 and 100 are not divided, as was the case with the head rail apertures of the prior art. This is particularly important with respect to transverse cut-out 100 since it allows the vertical support strings 24 and 24A of each ladder 22 to freely move between the outer edges of aperture 96 and the center of aperture 96. As shown in FIG. 5A, support strings 24 and 24A are thus able to move into closer proximity with one another when slats 28 are pivoted to a closed position. This will narrow the gap between the slats 28, so that a greater percentage of the light is blocked by slats 28. Preferably, the uppermost slat is disposed close enough to bottom wall 82 to allow a portion of the slat to be pivoted into channel 90 as shown in FIG. 5A. This blocks a greater percentage of light. Without channel 90, slats 28 could not be moved to their fully closed (vertical) position since the top slat would contact bottom wall 82 before reaching the fully closed position.

Basket frame 20 (See FIG. 6) also includes a similar unobstructed opening 104 which allows support strings 24 free movement between a fully opened position and a fully closed position without contacting any separator elements. Preferably, basket frame 20 has a bottom wall 106 which includes the single unobstructed opening 104. A pair of support walls 108 extend from bottom wall 106 and support rotator element 18. Framework 20 is reinforced by a pair of reinforcement walls or members 110 connected between the outside edges of support walls 108. Opening 104 extends between the reinforcement members and preferably spans more than one half the entire width of bottom wall 106. Of course, framework 20 may have various other configurations that also permit the use of a single unobstructed opening in the lower portion of the basket assembly.

It will be understood that the foregoing description is of a preferred exemplary embodiment of this invention, and that the invention is not limited to the specific forms shown. For example, the ladder apertures may be of various configurations depending on the overall design of the basket assemblies and the generally U-shaped cross-section of the head rail may be changed. These and other modifications may be made in the design and arrangement of the elements without departing from the scope of the invention as expressed in the appended claims.

We claim:

1. A mini blind system, comprising:

a head rail including a pair of side walls and a bottom wall, wherein the bottom wall includes a recessed channel extending along its length, the bottom wall further including at least two ladder apertures extending therethrough;

a basket assembly mounted in each ladder aperture and including a rotator element and a flexible ladder having a plurality of support strings;

a plurality of slats supported by the respective ladders whereby the slats may be pivoted between a substantially open position and a substantially closed position in response to rotation of the rotator element; and a rotator assembly configured to selectively rotate the rotator element, wherein each ladder aperture comprises an opening extending sufficiently inward along the bottom wall to prevent contact of the bottom wall with any Of the support strings when the plurality of slats is pivoted to the substantially closed position.

2. The mini blind system of claim 1, wherein the recessed channel is located between the side walls and spaced generally equally therefrom.

3. The mini blind system of claim 1, wherein the recessed channel portion has a cross-section in the shape of a truncated V.

4. The mini blind system of claim 1, wherein the recessed channel portion has a V-shaped cross-section.

5. The mini blind system of claim 1, wherein the recessed channel portion has a rectangular cross-section.

6. The mini blind system of claim 1, wherein the recessed channel portion has an arcuate cross-section.

7. The mini blind system of claim 1, wherein the recessed channel portion is a pair of recessed channels.

8. A mini blind system, comprising:

a head rail including a pair of side walls and a bottom wall, wherein this bottom wall includes a recessed channel extending along its length, the bottom wall further including at least two ladder apertures extending therethrough;

a basket assembly mounted in each ladder aperture and including a flexible ladder and a rotator element;

a plurality of slats supported by the respective ladders whereby the slats may be pivoted between a substantially open position and a substantially closed position in response to rotation of the rotator element; and means for selectively rotating the rotator element, wherein each ladder aperture is cross-shaped and includes a longitudinal cut-out intersected by a transverse cut-out.

9. The mini blind system of claim 8, wherein the longitudinal cut-out includes a portion of the recessed channel to create a pair of recessed channel aperture ends bordering the longitudinal cut-out.

10. The mini blind system of claim 9, wherein the longitudinal cut-out is sized to receive the basket assembly between the channel aperture ends.

11. The mini blind system of claim 10, wherein a plurality of corner tabs are formed in the bottom wall where the longitudinal cut-out intersects the transverse cut-out, the corner tabs providing support for the basket assembly.

12. The mini blind system of claim 11, wherein the transverse cut-out is unobstructed.

13. The mini blind system of claim 12, wherein the basket assembly includes a lower, unobstructed opening through which the flexible ladder extends, the opening corresponding generally to the transverse cut-out of the ladder aperture.

14. A mini blind system, comprising:

a head rail;

a plurality of pivotable slats;

means for suspending the slats from the head rail; means for pivoting the pivotable slats between a substantially open and a substantially closed position, the pivoting means including a plurality of support strings connected to the pivotable slats;

means for raising and lowering the slats; and wherein the head rail includes side walls and a bottom wall defining an elongate cavity and wherein the bottom wall further includes at least one elongate channel extending into the cavity and at least two apertures through which the plurality of support strings extend, each aperture comprising an opening extending sufficiently inward along the bottom wall to prevent contact of the bottom wall with any of the support strings when the plurality of slats is pivoted to the substantially closed position.

15. A mini blind system, comprising:

a head rail;

a plurality of pivotable slats;

means for suspending the slats from the head rail:

means for pivoting the pivotable slats between a substantially open and a substantially closed position;

means for raising and lowering the slats; and wherein the head rail includes side walls and a bottom wall defining an elongate cavity and wherein the bottom wall further includes at least one elongate channel extending into the cavity, wherein the bottom wall further includes two or more generally cross-shaped apertures extending therethrough.

16. The mini blind system of claim 15, wherein the suspending means comprises ladders.

17. The mini blind system of claim 16, wherein the pivoting means comprises a pair of basket assemblies, each basket assembly having a rotator element, each rotator element being connected to a ladder.

18. The mini blind system of claim 17, wherein the generally cross-shaped aperture is formed at least partially through the recessed channel portion and is sized to receive the basket assemblies.

19. A head rail for a mini blind system comprising:

a pair of side walls and a bottom wall forming an elongate cavity, wherein the bottom wall includes a channel along the length of the bottom wall, and further the bottom wall includes a plurality of apertures for receiving mini blind basket assemblies, each aperture being generally cross-shaped and extending therethrough.

20. The head rail of claim 19, wherein the channel has a cross-section in the shape of a truncated "V".

21. The head rail of claim 15, wherein the channel has a V-shaped cross-section.

22. The head rail of claim 15, wherein the channel has a rectangular cross-section.

23. The head rail of claim 15, wherein the channel has an arcuate cross-section.

24. The head rail of claim 15, wherein the channel is a pair of recessed channels.

25. A basket assembly for a mini blind system, comprising:

a framework having a bottom wall, a pair of support walls extending from the bottom wall generally parallel with each other, and a pair of reinforcement walls extending from the bottom wall, each reinforcement wall extending between and connected to each of the support walls; and a rotator element rotatably mounted on the support walls wherein the bottom wall includes a single unobstructed opening therethrough.

26. The basket assembly of claim 25, wherein the single opening spans over more than one half the bottom wall width.

27. The basket assembly of claim 26, further comprising a ladder attached to the rotator element and extending through the single opening.

* * * * *